US005899617A

United States Patent [19]

Tsai

[11] Patent Number: 5,899,617

[45] Date of Patent: May 4, 1999

[54] FLEXIBLE COMPONENT REINFORCING MECHANISM

[75] Inventor: Ching-Cheng Tsai, Chi Lung, Taiwan

[73] Assignee: Chicony Electronics Co., Ltd., Taipei Hsien, Taiwan

[21] Appl. No.: 08/947,911

[22] Filed: Oct. 9, 1997

[51] Int. Cl.[6] ..... B41J 5/12

[52] U.S. Cl. ..... 400/490; 400/495; 200/512

[58] Field of Search ..... 400/495, 490, 400/472; 200/512, 513

[56] References Cited

U.S. PATENT DOCUMENTS 5,718,327 2/1998 Wu ..... 200/512

5,738,450 4/1998 Lukosch ..... 400/495

*Primary Examiner*—John Hilten

*Attorney, Agent, or Firm*—Rosenberg, Klein & Bilker

[57] ABSTRACT

A type of flexible component reinforcing mechanism, the upward extension of said flexible component forming a connector part, inside said flexible main unit is an activator body, the downward extension of the flexible component forms a base, characterized in a number of spaced reinforcing units that are located at the intersection part between the flexible main unit and the connector part; said configuration is designed to form better strength on the intersection part which is the most frequently broken or damaged part of the flexible component, to significantly reduce the occurrence of broken or damaged intersection part.

3 Claims, 6 Drawing Sheets

PIROR ART

PIROR ART

FLEXIBLE COMPONENT REINFORCING MECHANISM

BACKGROUND OF THE INVENTION

The subject invention relates to a type of flexible component reinforcing mechanism, or specifically to a type of flexible component that will form a better strength, and significantly reduce the occurrence of broken or damaged parts.

As illustrated in FIGS. 1 and 2, there is the flexible component 10 in the push key device of a conventional computer keyboard, said flexible component 10 is made of a flexible rubber material, involving a flexible main unit 11, the upward extension of said flexible main unit 11 forms a connector part 12, in the direction away from the connector part 12 in the vertical direction inside said flexible main unit 11 is an activator body 13, the downward extension of the flexible main unit 11 forms a base 14. The flexible component 10 may be joined by the connector part 12 to the lower end of the key post 16 at the bottom of the push key 15. When the push key 15 is depressed, the key post 16 at the bottom of the push key will press down on the flexible component 10, so that the activator body 13 inside the flexible component 10 moves down to contact the film circuit (not shown in drawing) below to connect the current, when the key 15 is released, the flexibility of the flexible component 10 will reset the key 15 to its original position.

After extended use, however, said conventional flexible component 10 will no longer be used regularly because the intersection part 18 between the flexible main unit 11 and the connector part 12 would often be broken or damaged.

SUMMARY OF THE INVENTION

The primary objective of the subject invention is to present a type of flexible component reinforcing mechanism, characterized in a number of reinforcing units located at the intersection part between the flexible main unit and the connector part inside the flexible component, by the installation of the reinforcing units, the intersection part which is an easily broken or damaged part of the flexible component will have a better strength, to significantly reduce the occurrence of broken or damaged intersection part, so that the flexible component may be maintained in a normal working condition and a longer service life.

To enable your better understanding of the characteristics and technical contents of the subject invention, please refer to the following detailed description with drawings; however, the attached drawings are only for the purposes of reference and description, which shall not be based to restrict or limit the subject invention:

BRIEF DESCRIPTION OF NUMERALS

| | |
|---|---|
| 10 flexible component | 11 flexible main unit |
| 12 connector part | 13 activator body |
| 14 base | 15 push key |
| 16 key post | 18 intersection part |
| 19 reinforcing unit | |

DETAILED DESCRIPTION OF PREFERRED EMBODIMENT

Figure 1:
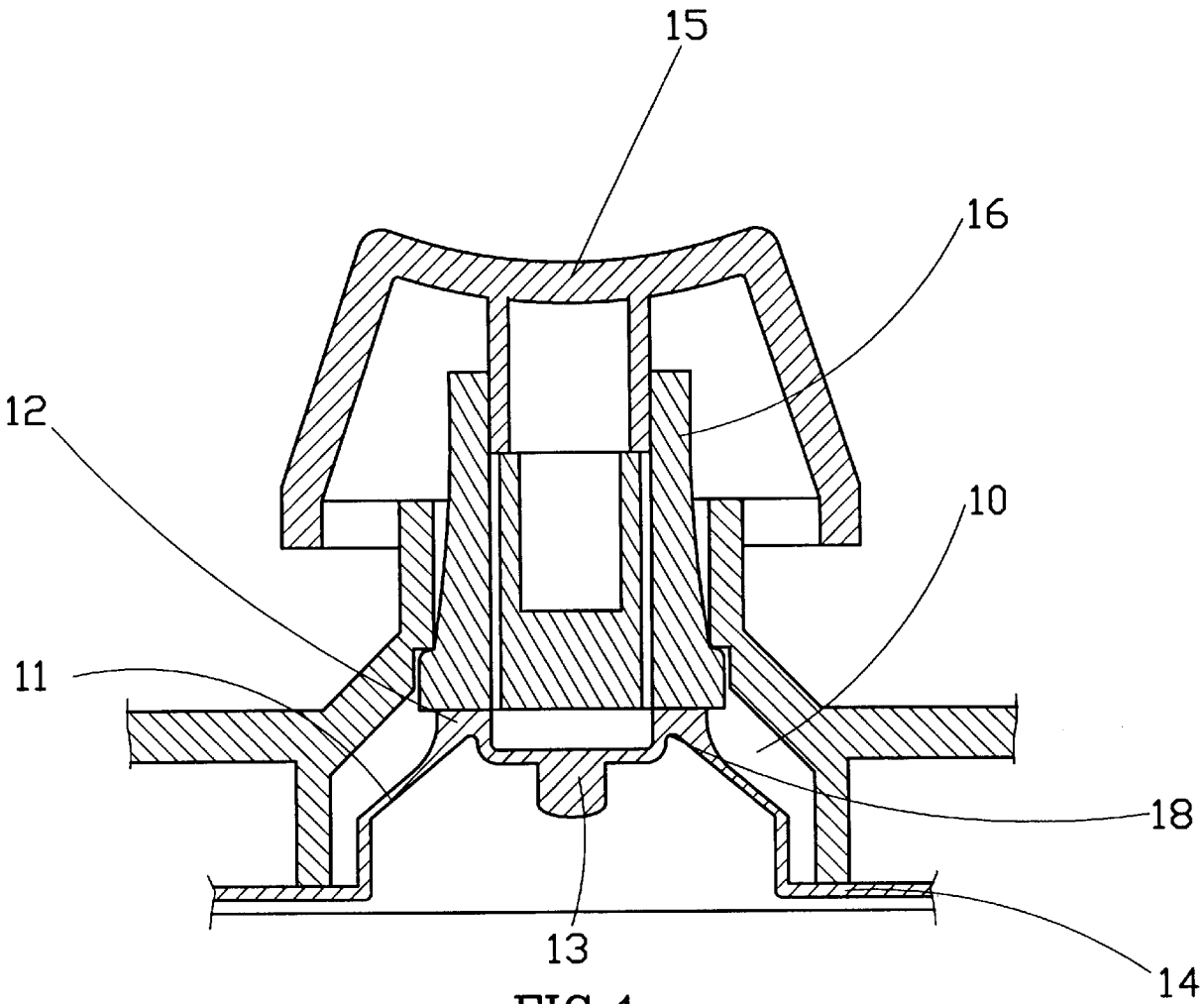
FIG. 1 is a plain sectional view of a prior art of push key.
Figure 2:
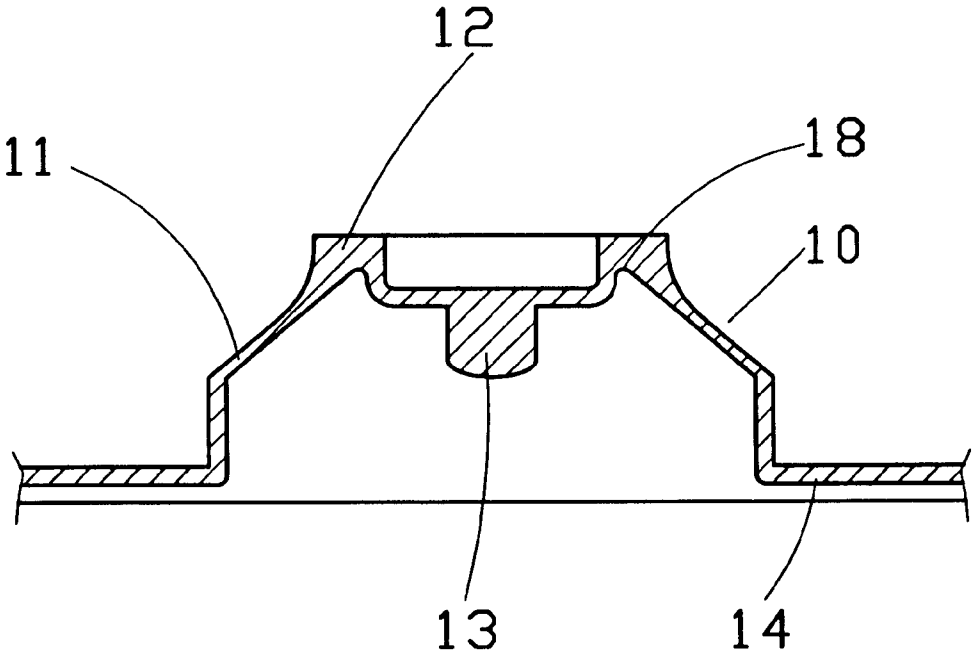
FIG. 2 is a plain sectional view of a prior art of flexible component.
Figure 3:
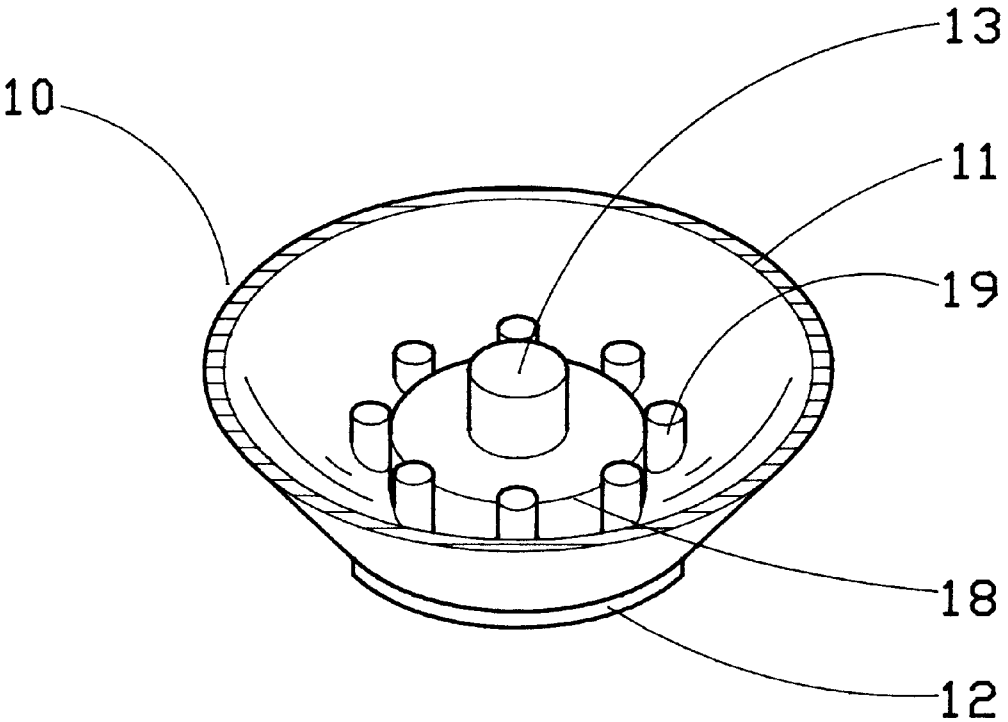
FIG. 3 is a perspective view of the subject invention of flexible component.
Figure 4:
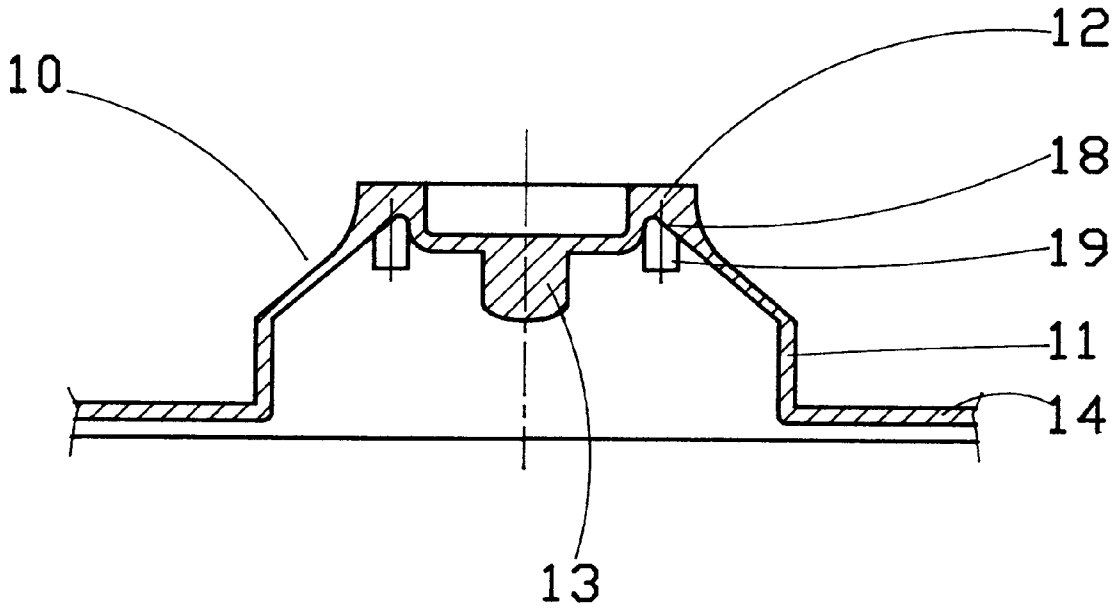
FIG. 4 is a plain sectional view of the subject invention of flexible component.
Figure 5:
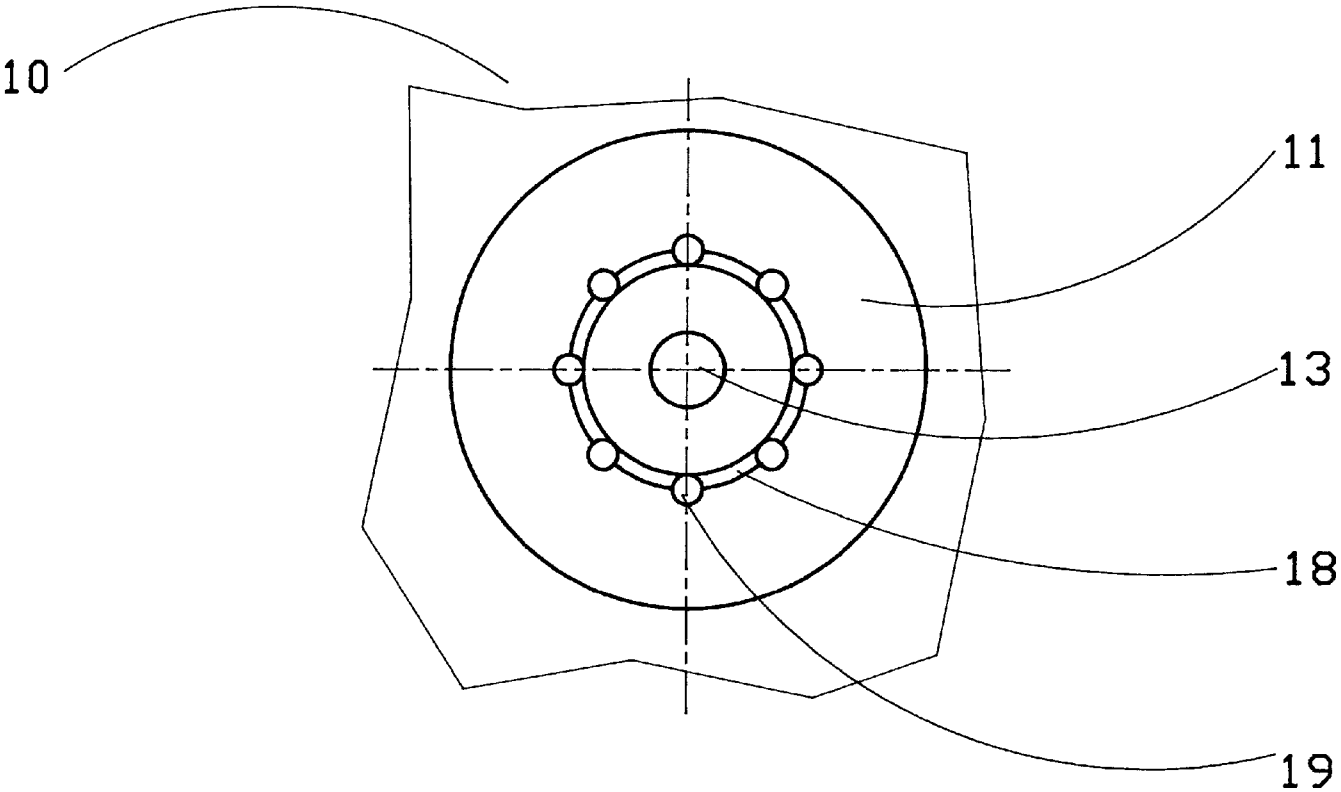
FIG. 5 is a top 0view of the subject invention of flexible component.

As illustrated in FIGS. 3, 4 and 5, the subject invention relates to the presentation of a type of flexible component reinforcing mechanism, said flexible component 10 is applied to the push key device in a computer keyboard or other electronic products, said flexible component 10 is made of a flexible rubber material, shaped like a reverted bowl, said flexible component 10 is a hollow flexible main body, on the upward extension of said flexible main unit 11 is a connector part 12 that connects with the push key, in the direction away from the connector part 12 in the vertical direction inside said flexible main body 11 is an activator body 13, the flexible main unit 11 extends downward to form a base 14.

Figure 6:
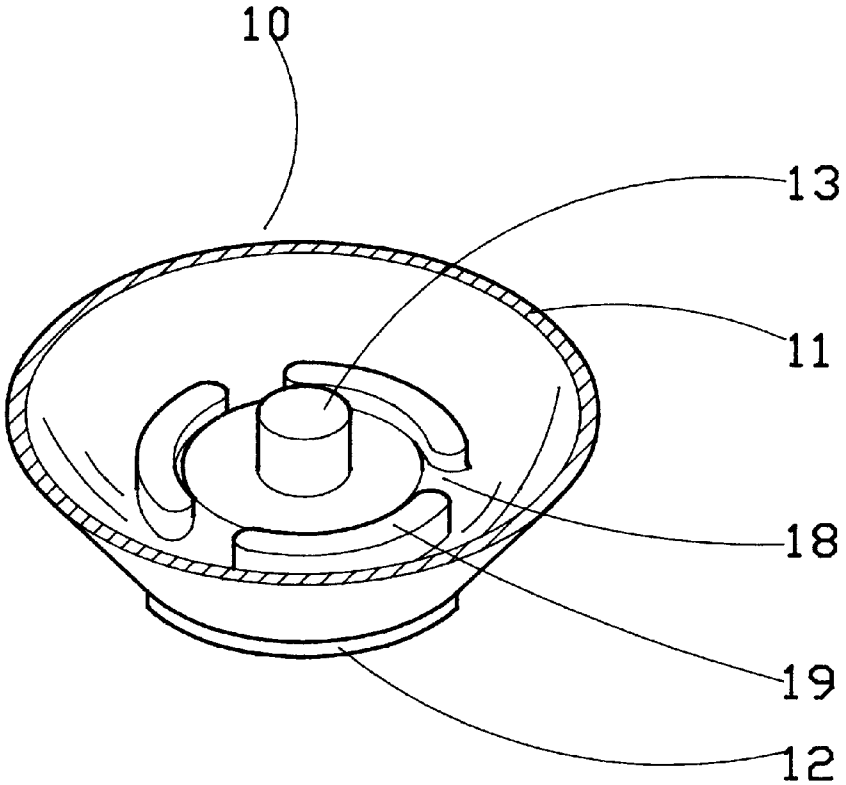
FIG. 6 is a perspective view of the subject invention of flexible component.

The subject invention of flexible component reinforcing mechanism relates mainly to a number of reinforcing units 19 that are equally spaced and monoblock formed at the intersection part 18 between the flexible main unit 11 and the connector part 12, said reinforcing unit 19 may be shaped like a protruding post, or like an elongated strip (as illustrated in FIG. 6) or other shapes, by means of the installation of the reinforcing units 19, the intersection part 18 that would most frequently be broken or damaged in the flexible component 10 may form better strength, to significantly reduce the occurrence of broken or damaged intersection part 18, so the flexible component 10 may maintain its normal operation and its service life may be extended.

Summing up, the subject invention with effective improvement on the weaknesses in conventional flexible components, such as easily broken or damaged intersection part between the flexible component and the connector part, and other problems that would result in failure of the flexible component to work properly, is an unprecedented new version that will fully meet the qualifications for a patent right, hence this application is filed in accordance with the Patent Law to protect the subject inventor's rights and interests. Your favorable consideration shall be appreciated.

It is declared hereby that the above description, covering only the preferred embodiment of the subject invention, should not be based to limit or restrict the subject claim, and that all equivalent structural and/or configurational variations and/or modifications easily conceivable to anyone skilled in the subject art, and deriving from the subject description with drawings herein shall reasonably be included in the intent of the subject claim.

I claim:

1. A reinforced flexible component for a keyboard switch comprising a base portion, and a hollow flexible main unit having an upwardly extending portion extending from said base portion, said main unit having (a) a connector section formed at an upward extent of said upwardly extending portion for interface with push key, (b) a downwardly extending activator body formed on a lower surface of said main unit, and (c) a plurality of angularly spaced reinforcing members extending downwardly from a portion of said lower surface corresponding to an intersection of said upwardly extending portion with said connector section.

2. The reinforced flexible component as recited in claim 1 where each of said plurality of reinforcing members has a post-shaped contour.

3. The reinforced flexible component as recited in claim 1 where each of said plurality of reinforcing members has an elongated strip-shaped contour.

* * * * *